US007549471B2

(12) United States Patent
Aivalis et al.

(10) Patent No.: US 7,549,471 B2
(45) Date of Patent: Jun. 23, 2009

(54) DEPLOYMENT TOOL FOR WELL LOGGING INSTRUMENTS CONVEYED THROUGH THE INTERIOR OF A PIPE STRING

(75) Inventors: James G. Aivalis, Katy, TX (US); Corey McGillivary, Red Deer (CA)

(73) Assignee: Thrubit, LLC, Houston, TX (US)

( * ) Notice: Subject to any disclaimer, the term of this patent is extended or adjusted under 35 U.S.C. 154(b) by 279 days.

(21) Appl. No.: 11/646,752

(22) Filed: Dec. 28, 2006

(65) Prior Publication Data

US 2008/0156477 A1 Jul. 3, 2008

(51) Int. Cl.
*E21B 47/09* (2006.01)

(52) U.S. Cl. ..... 166/254.2; 166/255.1; 188/68

(58) Field of Classification Search ..... 166/250.01, 166/254.2, 255.1, 381; 188/68, 82.84
See application file for complete search history.

(56) References Cited

U.S. PATENT DOCUMENTS 2,338,028 A * 12/1943 Doll ..... 33/313
5,184,676 A 2/1993 Graham et al.
5,282,641 A 2/1994 McLaughlin
5,285,008 A 2/1994 Sas-Jaworski et al.
6,273,189 B1 8/2001 Gissler et al.
6,443,247 B1 9/2002 Wardley
6,561,278 B2 5/2003 Restarick et al.
6,663,453 B2 12/2003 Quigley et al.
7,303,010 B2 * 12/2007 de Guzman et al. ..... 166/255.1
2004/0074639 A1 4/2004 Runia et al.
2004/0118611 A1 6/2004 Runia et al.
2005/0029017 A1 2/2005 Berkheimer et al.
2005/0288819 A1 12/2005 de Guzman
2006/0118298 A1 6/2006 Millar et al.

* cited by examiner

*Primary Examiner*—William P Neuder
(74) *Attorney, Agent, or Firm*—Conley Rose, P.C.

(57) ABSTRACT

A deployment device for controlling rate of movement of an instrument inside a conduit includes a mandrel having a coupling to affix the deployment device to the instrument and a controllable brake disposed in the mandrel, the brake controllably actuatable to maintain the mandrel and instrument at a selected speed within the conduit.

29 Claims, 7 Drawing Sheets

DEPLOYMENT TOOL FOR WELL LOGGING INSTRUMENTS CONVEYED THROUGH THE INTERIOR OF A PIPE STRING

CROSS-REFERENCE TO RELATED APPLICATIONS

Not applicable.

STATEMENT REGARDING FEDERALLY SPONSORED RESEARCH OR DEVELOPMENT

Not applicable.

BACKGROUND OF THE INVENTION

1. Field of the Invention

The invention relates generally to the field of well logging instrument conveyance devices. More specifically, the invention relates to devices used to move a well logging instrument through the interior of a pipe string so that the well logging instrument can be deployed in a wellbore.

2. Background Art

Well logging instruments are used, among other purposes, to make measurements of physical properties of Earth formations that have been penetrated by a wellbore. Well logging instruments typically include one or more types of sensors to make the measurements of the physical properties. Signals from the sensors may be communicated to the Earth's surface by various forms of signal telemetry, and/or may be stored in various types of recording device disposed within the well logging instrument.

As the well logging instrument is moved along the wellbore, a record of the signals generated by the sensors is made with respect to time and/or depth of the sensors within the wellbore. There are a number of different devices known in the art for moving the well logging instrument along the wellbore. The instrument may be affixed to the end of an armored electrical cable, which is unwound from w winch or similar spooling device to extend the instrument into the wellbore by the action of Earth's gravity. The instrument is withdrawn by rewinding the cable onto the winch. The well logging instrument may be moved along the wellbore by coupling it to the end of a coiled tubing, and unspooling and spooling the coiled tubing to move the instrument into and out of the wellbore. The instrument may also be coupled to the end of a threadedly coupled pipe, called a pipe "string." The pipe string with the instrument attached to the lower end thereof is extended into the wellbore by threadedly coupling segments of pipe end to end. The pipe string is withdrawn from the wellbore by threadedly uncoupling segments of pipe.

U.S. Patent Application Publication No. 2004/0074639 filed by Runia discloses another device for moving the well logging instrument along the wellbore. The system comprises a tubular conduit or pipe extending from the Earth's surface into the wellbore containing a body of wellbore fluid. A well logging instrument string is included that is capable of passing from a position within the conduit to a position outside the conduit at a lower end part thereof and capable of being suspended by the conduit in said position outside the conduit. In some embodiments the well logging instrument may include a pressure pulse device arranged within the conduit in a manner that the pressure pulse device is in data communication with the logging tool. The pressure pulse device is capable of generating pressure pulses in the body of wellbore fluid, the pressure pulses representing data communicated by the logging tool string to the pressure pulse device during logging of Earth formation by the logging tool string.

In using the device disclosed in the Runia '639 publication it has been found desirable to be able to control the speed of movement of the well logging instrument inside the conduit, particularly when the conduit is disposed in a vertical or nearly vertical wellbore. Conversely, it is necessary to provide some mechanism to move the well logging instrument along the interior of the conduit when the wellbore is highly inclined form vertical such that Earth's gravity is incapable of moving the well logging instrument sufficiently.

SUMMARY OF THE INVENTION

A deployment device for controlling rate of movement of an instrument inside a conduit according to one aspect of the invention includes a mandrel having a coupling to affix the deployment device to the instrument and a controllable brake disposed in the mandrel, the brake controllably actuatable to maintain the mandrel and instrument at a selected speed within the conduit.

Other aspects and advantages of the invention will be apparent from the following description and the appended claims.

DETAILED DESCRIPTION

Figure 1:
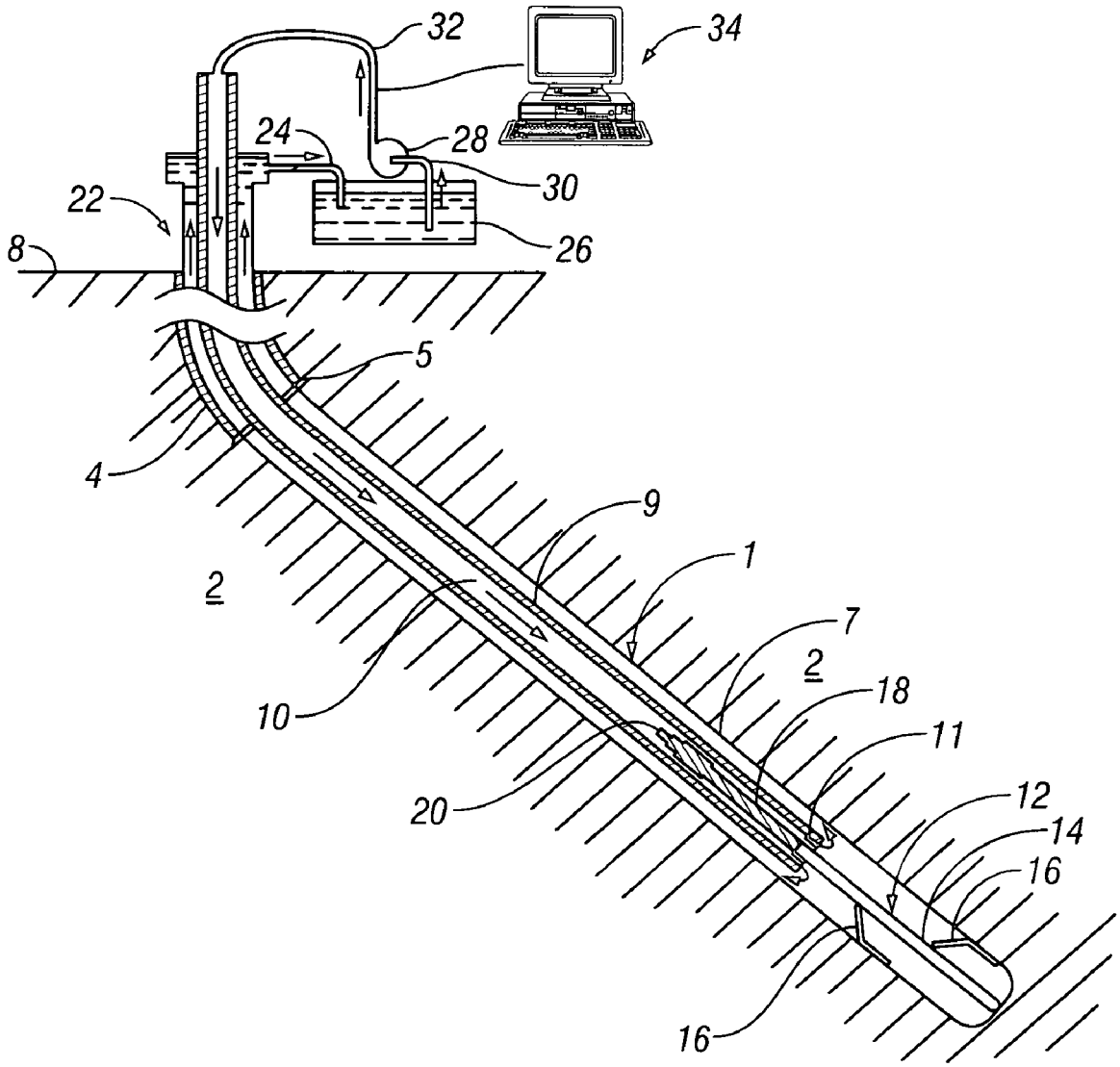
FIG. 1 schematically shows a first embodiment of the logging system of the invention, using a casing extending in the wellbore.

FIG. 1 shows a wellbore 1 formed in an Earth formation 2, the wellbore being filled with drilling fluid. The wellbore 1 has an upper portion provided with a casing 4 extending from a drilling rig (not shown) at the Earth's surface 8 into the wellbore 1 to a casing shoe 5, and an open lower portion 7 extending below the casing shoe 5. A conduit, which in the present embodiment is a tubular drill string 9 containing a body of drilling fluid 10 and having an open lower end 11, extends from the drilling rig (not shown) into the wellbore 1 whereby the open lower end 11 is disposed in the open lower wellbore portion 7. A well logging instrument 12 capable of being lowered or raised through the drill string 9, is retrievably suspended in the drill string 9 by a deployment device 12A, which will be explained in more detail with reference to FIG. 4. The well logging instrument 12 includes one or more types of sensors, including, for example, a formation tester (FT) tool 14 having retractable arms 16. The logging instrument may include a fluid pressure pulse device 18 arranged at the upper end of the FT tool 14, whereby the FT tool 14 extends below the lower end part 11 of the drill string 9 and the pressure pulse device 18 is disposed within the drill string 9. The FT tool 14 may be powered by a battery (not shown) and can be provided with an electronic memory (not shown) or other recording medium for storing measurement data, which for the FT tool 14 may include measurements of fluid pressure in the Earth formation 2 at selected depths therein.

It is to be clearly understood that the FT tool 14 shown in FIG. 1 is only an example of a well logging sensor or instrument that may be used with a deployment device according to the invention. It is within the scope of this invention that any known well logging sensor or instrument that can be moved through the inside of a tube or conduit may be used with a deployment device according to the invention. Such sensors and/or instruments include, without limitation, acoustic sensors, electromagnetic resistivity sensors, galvanic resistivity sensors, seismic sensors, Compton-scatter gamma-gamma density sensors, neutron capture cross section sensors, neuron slowing down length sensors, calipers, gravity sensors and the like.

The fluid pressure pulse device 18 has a variable flow restriction (not show) which is controlled by electric signals transmitted by the FT tool 14 to the pressure pulse device 18, which signals represent part of the data produced by the FT tool 14 during the making of measurements of the earth formation 2. The upper end of the deployment device 12A may be provided with a latch 20 for latching of an armored electrical cable (not shown) to the device 12A for retrieval from the bottom of the drill string 9.

A wellhead 22 is typically connected to the upper end of the casing 4 and is provided with an outlet conduit 24 terminating in a drilling fluid reservoir 26 provided with a suitable sieve means (not shown) for removing drill cuttings from the drilling fluid. A pump 28 having an inlet 30 and an outlet 32 is arranged to pump drilling fluid from the fluid reservoir 26 into the upper end of the drill string 9.

A control system 34 located at the Earth's surface is connected to the drill string 9 for sending or receiving fluid pressure pulses in the body of drilling fluid 10 to or from the fluid pressure pulse device 18.

Figure 2:
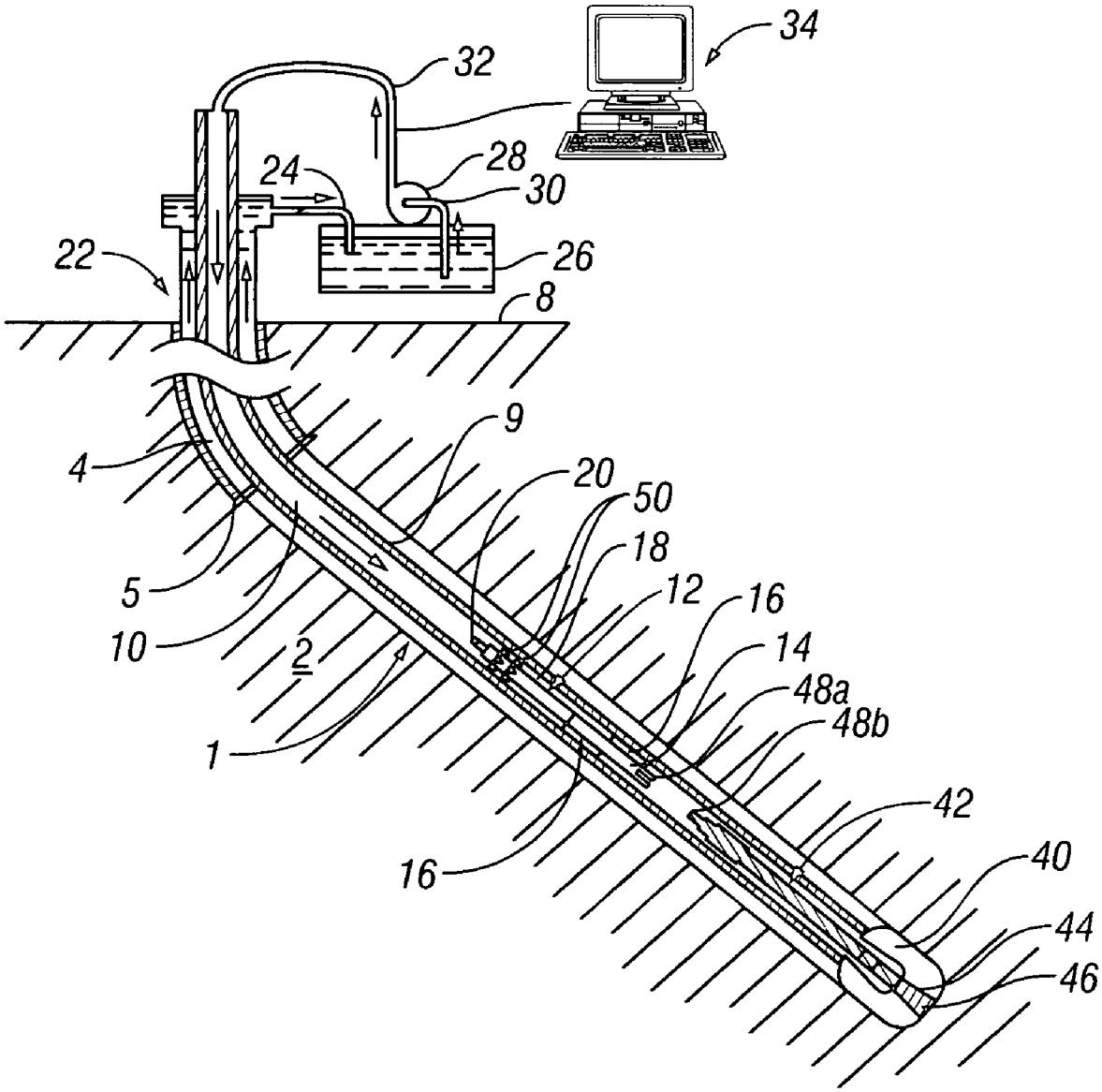
FIG. 2 schematically shows a second embodiment of the logging system of the invention, using a drill string extending in the wellbore.

A second embodiment shown in FIG. 2 is largely similar to the first embodiment, except with respect to the following aspects. The drill string is provided with a drill bit 40 at the lower end thereof, a measurement-while-drilling (MWD) device 42 is removably arranged in the lower end part of the drill string 9, and the logging instrument 12 is shown as being lowered through the drill string 9. The drill bit 40 is provided with a passage 44 in fluid communication with the interior of the drill string 9, which passage 44 is provided with a closure element 46 removable from the passage 44 in outward direction and connected to the MWD device 42. The lower end of the logging instrument 12 and the upper end of the MWD device 42 are provided with respective cooperating latching members 48*a*, 48*b* capable of latching the logging tool string 12 to the MWD device 42. Furthermore, the deployment device 12A may be provided with pump cups 50 for pumping the logging instrument 12 through the drill string 9, either in downward or upward direction thereof.

The closure element 46 has a latching mechanism (not shown) for latching the closure element 46 to the drill bit 40. The latching mechanism is arranged to co-operate with the latching members 48*a*, 48*b* in a manner that the closure element 46 unlatches from the drill bit 40 upon latching of latching member 48*a* to latching member 48*b*, and that the closure element 46 latches to the drill bit 40, and thereby closes passage 44, upon unlatching of latching member 48*a* from latching member 48*b*.

Figure 3:
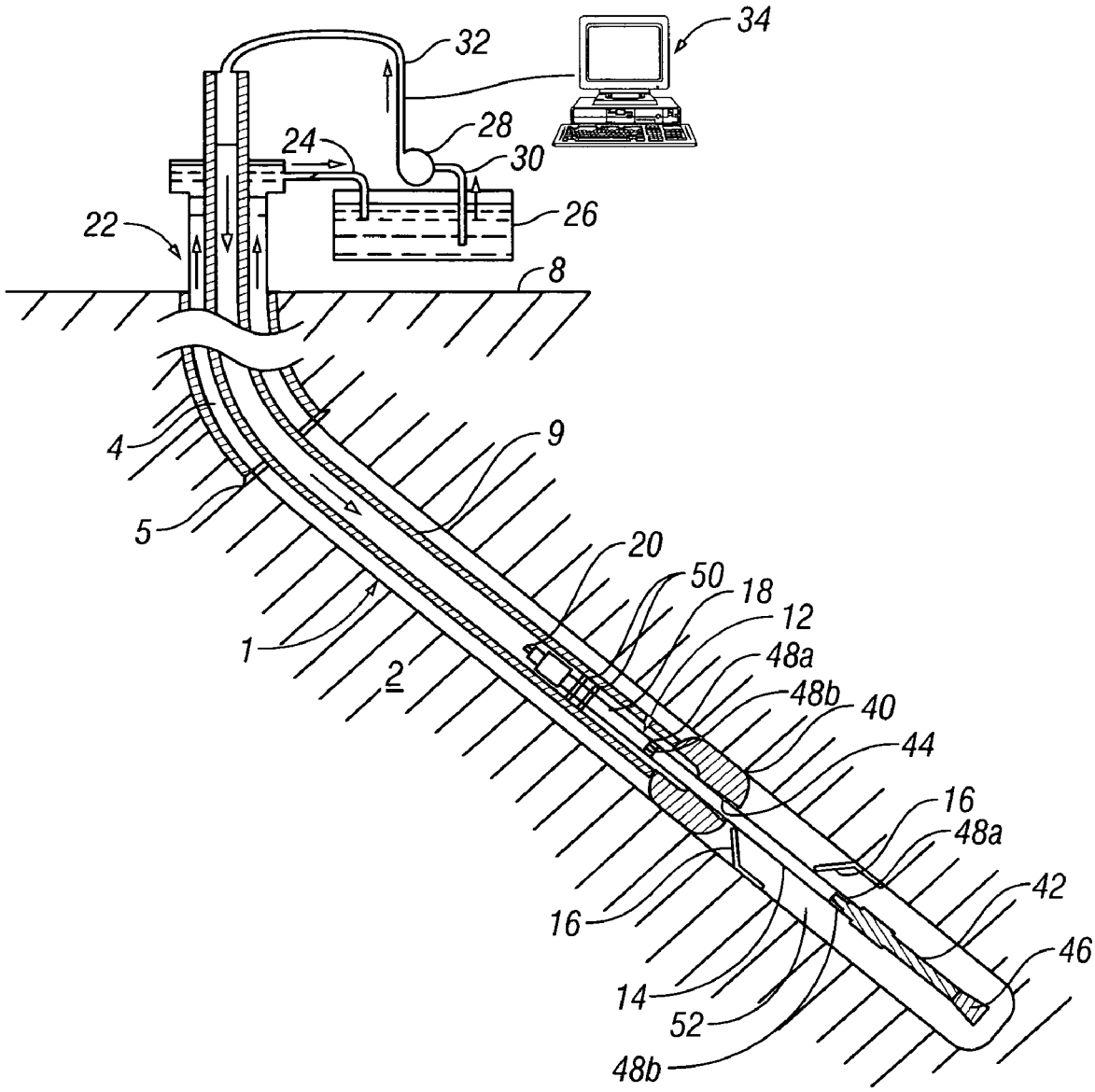
FIG. 3 schematically shows the embodiment of FIG. 2 during a further stage of operation.

In FIG. 3 shows the embodiment of FIG. 2 during a further stage of operation whereby the logging instrument 12 has been latched to the MWD device 42 and the closure element 46 has been unlatched from the drill bit 40. The drill string 9 has been raised a selected distance in the wellbore 1 so as to leave a space 52 between the drill bit 40 and the wellbore bottom. The logging instrument 12 is suspended by the drill string 9 in a manner that the FT tool 14 extends through the passage 44 to below the drill bit 40, and that the pressure pulse device 18 is arranged within the drill string 9. The MWD device 42 and the closure element 46 consequently extend below the logging tool string 12.

During normal operation of the embodiment of FIG. 1, the drill string 9 is lowered into the wellbore 1 until the lower end of the string 9 is positioned in the open wellbore portion 7. Next the logging instrument 12 is lowered from surface through the drill string 9 by means of the deployment device 12A, whereby during lowering the arms 16 are retracted. Lowering continues until the FT tool 14 extends below the drill string 9 while the pressure pulse device 18 is positioned within the drill string 9, in which position the logging instrument 12 is suitably supported. The arms 16 are then extended against the wall of the wellbore and the FT tool 14 is induced to make its measurements of the Earth formation 2. The measurement data may be stored in the electronic memory, and part of the logging data may be transmitted by the FT tool 14 in the form of electrical signals to the pressure pulse device 18, which signals induce controlled variations of the variable flow restriction.

Simultaneously with operating the logging instrument 12, drilling fluid is pumped by pump 28 from the fluid reservoir 26 into the drill string 9 via inlet 30 and outlet 32. The controlled variations of the variable flow restriction induce corresponding pressure pulses in the body of drilling fluid present in the drill string 9, which pressure pulses are monitored by the control system 34. In this manner the system operator can monitor the well logging operation and can take corrective action if necessary. For example, incorrect deployment of the arms 16 of the RFT tool can be detected in this manner at an early stage.

After the logging run has been completed, the logging instrument 12 may retrieved through the drill string 9 to surface by wireline connected to latch 20. Optionally the drill string 9 is then removed from the wellbore 1.

During normal operation of the embodiment of FIGS. 2 and 3, the drill string 9 is operated to drill the lower wellbore portion 7 whereby the closure element 46 is latched to the drill bit 40 so as to form a part thereof. The MWD device 42 induces fluid pressure pulses in the body of drilling fluid 10 representative of selected drilling parameters such as wellbore inclination or wellbore temperature. The use of MWD devices is known in the art of drilling, and will not be explained in more detail in this context.

When it is desired to log the earth formation 2 surrounding the open wellbore portion 7, the logging tool string 12 is pumped down the drill string 9 using pump 28 until the logging tool string 12 latches to the MWD device 42 by means of latching members 48*a*, 48*b*. During lowering of the string 12, the arms 16 of the FT tool 14 are retracted. Then the drill string 9 is raised a selected distance until there is sufficient space below the drill string for the FT tool 14, the MWD device 42 and the closure element 46 to extend below the drill bit 40. Upon latching of latching member 48*a* to latching member 48*b*, the closure element 46 unlatches from the drill bit 40. Continuous operation of pump 28 causes further downward movement of the combined logging tool string 12, MWD device 42 and closure element 46 until the logging tool string 12 becomes suspended by the drill string. In this position (shown in FIG. 3) the FT tool 14 extends through the passage 44 into the space 52 below the drill bit 40, and the pressure pulse device 18 and closure element 46 extend below the FT tool in the space 52.

The arms 16 are then extended against the wall of the wellbore and the FT tool 14 is operated to measure the Earth formation 2. The measurement data are stored in the electronic memory, and part of the data are transmitted by the FT device 14 in the form of electrical signals to the pressure pulse device 18, which signals induce controlled variations of the variable flow restriction of the MWD device 42.

Simultaneously with operating the logging tool string 12, drilling fluid is pumped by pump 28 from the fluid reservoir 26 into the drill string 9 via inlet 30 and outlet 32. The controlled variations of the variable flow restriction induce corresponding pressure pulses in the body of drilling fluid present in the drill string 9, which pressure pulses are monitored by the control system 34. Thus, the operator is in a position to monitor the logging operation and to take corrective action if necessary (similarly to the embodiment of FIG. 1).

After measuring has been completed, the instrument 12 may be retrieved to surface through the drill string 9 by wireline connected to latch 20 at the top of the deployment device 12A. During retrieval the closure element 46 latches to the drill bit 40 (thereby closing the passage 44) and the latching members 48*a*, 48*b* unlatch. Alternatively the instrument 12 can be retrieved to surface by reverse pumping of drilling fluid, i.e. pumping of drilling fluid down through the annular space between the drill string 9 and the wellbore wall and into the lower end of the drill string 9. Optionally a further wellbore section then can be drilled, or the drill string 9 can be removed from the wellbore 1.

As will be readily appreciated by those skilled in the art, during deployment of the well logging instrument 12 into the drill string 9, and during removal therefrom, it is desirable to be able to control the speed of movement of the instrument 12 within the drill string. A deployment device 12A according to the invention is configured to control the speed of motion of the instrument 12 along the interior of the drill string 9, and where appropriate, can provide motive power to move the instrument 12 along the interior of the drill string 9 during deployment or withdrawal of the instrument 12.

Figure 4:
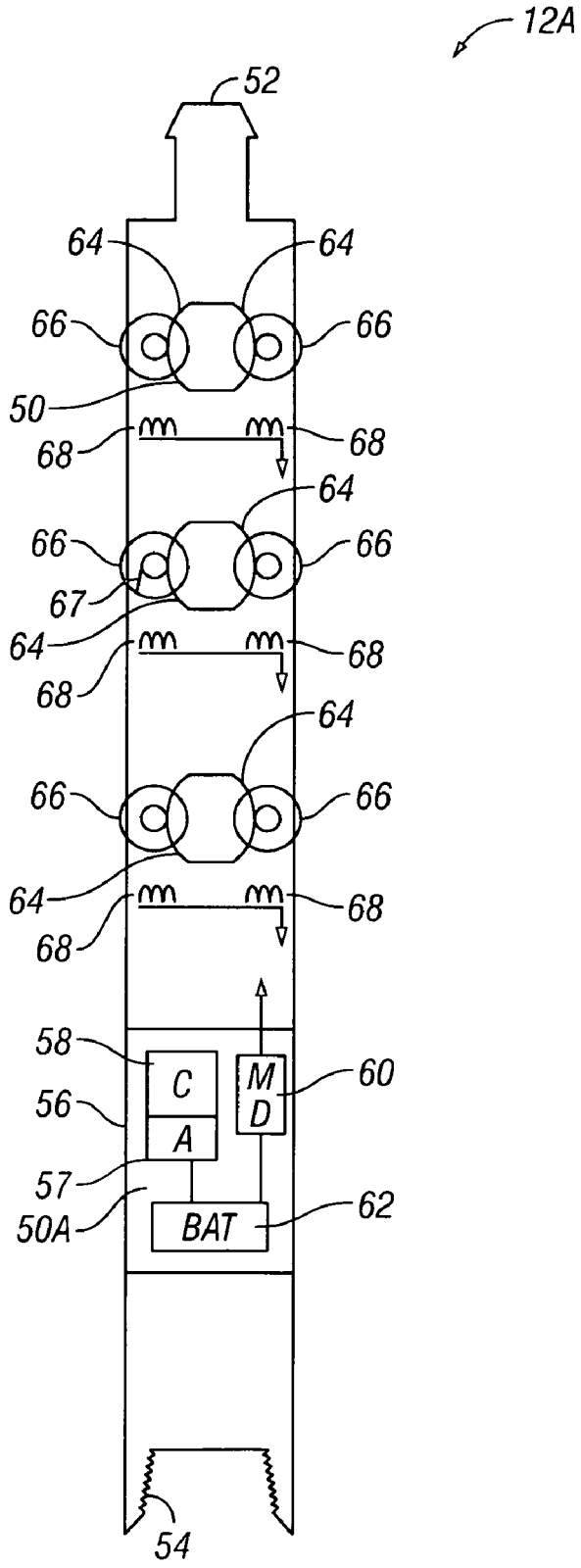
FIG. 4 shows one embodiment of a deployment device according to the invention.

One embodiment of the deployment device 12A will now be explained with reference to FIG. 4. The deployment device 12A includes a generally cylindrically shaped mandrel 50 that can traverse the interior of the drill string (9 in FIG. 1) or other pipe or conduit extended into the wellbore. The mandrel 50 may include a fishing neck 52 or similar latching device at its upper end to enable retrieval of the device 12A under particular circumstances such as by wireline (electrical cable), or coiled tubing, for example should such retrieval prove necessary. The lower end of the mandrel 50 includes a threaded connector 54 or other mechanism to couple the deployment device 12A to the upper end of the well logging instrument (12 in FIG. 1). A pressure sealed compartment 50A disposed in a portion of the mandrel 50, which may be an enclosure or a separate module or "sub" 56, includes power and control electronics disposed therein. Such electronics may include a rechargeable battery 62, a programmable, microprocessor based system controller 58 and a motor driver 60.

In the present embodiment, the motor driver 60 can generate alternating current used to operate drive motors, as will be further explained. The motor driver 60 may also induce alternating current in such drive motors such that the motors provide electrically regenerative braking. The controller 58 can provide control signals to operate the motor driver 60 such that a substantially constant, or other controlled speed of movement of the deployment device 12A along the interior of the drill string can be maintained.

In the present embodiment, the drive motors can be induction motors formed by combination of high magnetic permeability steel traction wheels 66 that are held in frictional contact with the interior wall of the drill string (or other conduit) by a biasing device such as bow springs 64 acting on the wheels' axles. The wheels 66 may each be disposed proximate to a corresponding induction coil 68. One or more of the wheels 66 may include embedded permanent magnets 67 to assist in regenerative braking, as will be further explained. The particular biasing device shown in this embodiment is not intended to limit the scope of the invention. Alternative biasing devices may be used in other embodiments, such as pressurized hydraulic or pneumatic cylinders, coil springs, and shape memory metal springs, for example.

As the deployment device 12A moves downward inside the pipe or conduit by gravity, the rate of descent may be controlled by suitable current being passed through the induction coils 68 by the motor driver 60 so as to electrically brake the wheels 66. Electrical power may be generated by such braking, and the generated power may be conditioned and supplied to the battery 62 to maintain its charge. Conversely, when it is necessary to supply motive power to move the device 12A and the well logging instrument (12 in FIG. 1) coupled thereto along the interior of the conduit, such as in highly inclined wellbores, the motor driver 60 may supply suitable alternating current to the induction coils 68 to cause the wheels 66 to turn, thus moving the mandrel 50. The amount and rate of rotation and/or braking force may be selected by the controller 58 to maintain any selected rate of motion of the mandrel 50 along the inside of the conduit. Rate of motion of the mandrel 50 may be determined using, for example an accelerometer 57 or similar device in signal communication with the controller 58.

Figure 4A:
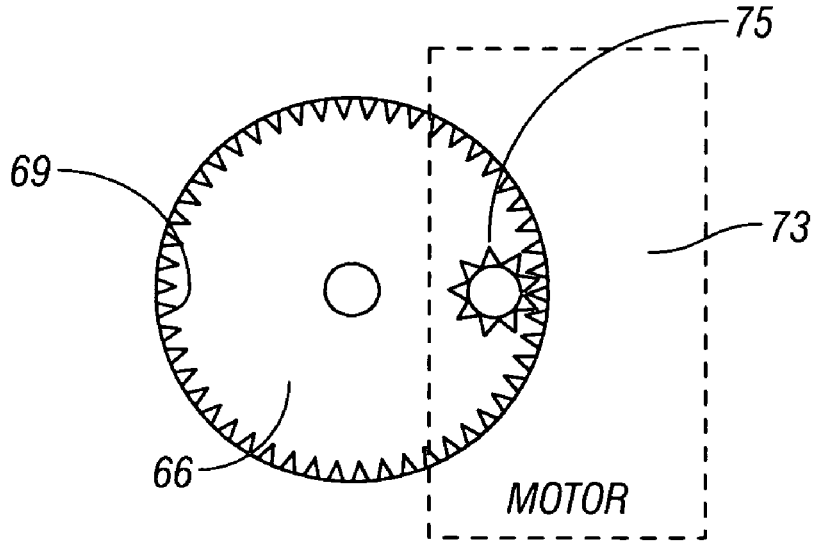
FIGS. 4A and 4B show alternative arrangements of a motor and a traction drive wheel.

The present embodiment includes components intended to cause the wheels 66 to act as the rotors in an induction motor. It will be appreciated by those skilled in the art that the wheels 66 may be driven by alternative arrangements of a motor rotationally coupled to the wheels 66. FIG. 4A shows one possible arrangement. One or more of the wheels 66 may in such embodiments include a ring gear 69 formed inward of the outer surface of the wheel 66. A spur gear 75 coupled to the output shaft of a motor 73 may be placed in contact with the ring gear 69 to cause wheel rotation by operation of the motor 73. The arrangement shown in FIG. 4A may also provide regenerative braking as the wheel 66 rotates the motor 73.

Figure 4B:
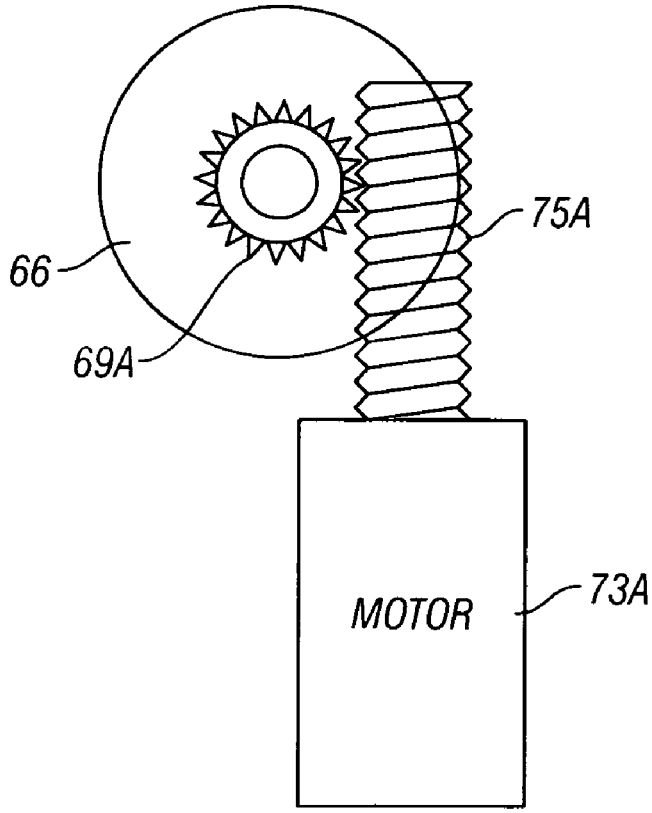

Another arrangement is shown in FIG. 4B, in which the wheel 66 includes a ring gear 69A disposed on a surface proximate the wheel axle. A motor 73A may have on its output shaft a worm gear 75A in contact with the ring gear 69A. Rotation of the motor 73A will thus drive the wheel 66. The arrangement shown in FIG. 4B may be advantageous when it is desirable not to enable motion of the deployment deice (12A in FIG. 1) except by operation of the motor 73A.

An alternative type of motor that may be used in embodiments such as shown in FIGS. 4A and 4B will now be explained with reference to FIG. 4C. The motor (73 in FIG. 4A or 73A in FIG. 4B) in the present embodiment can be an hydraulic motor 73B. The hydraulic motor 73B has its inlet and outlet lines, 173B, 273B, respectively, coupled to a two-port, three-way valve 94. The three way valve 94 may be actuated by a solenoid 96. The solenoid 96 may be operated by a circuit corresponding to the controller and motor driver (58, 60, respectively in FIG. 4). In the center position, shown in FIG. 4C, the three way valve 94 couples the inlet line 173B to the outlet line 273B of the motor 73B to enable the motor to be rotated freely by the wheel (66 if the embodiment of FIG. 4A is used) which it drives. Thus, when the three-way valve 94 is in the center position, the deployment device may move relatively unhindered.

Figure 4C:
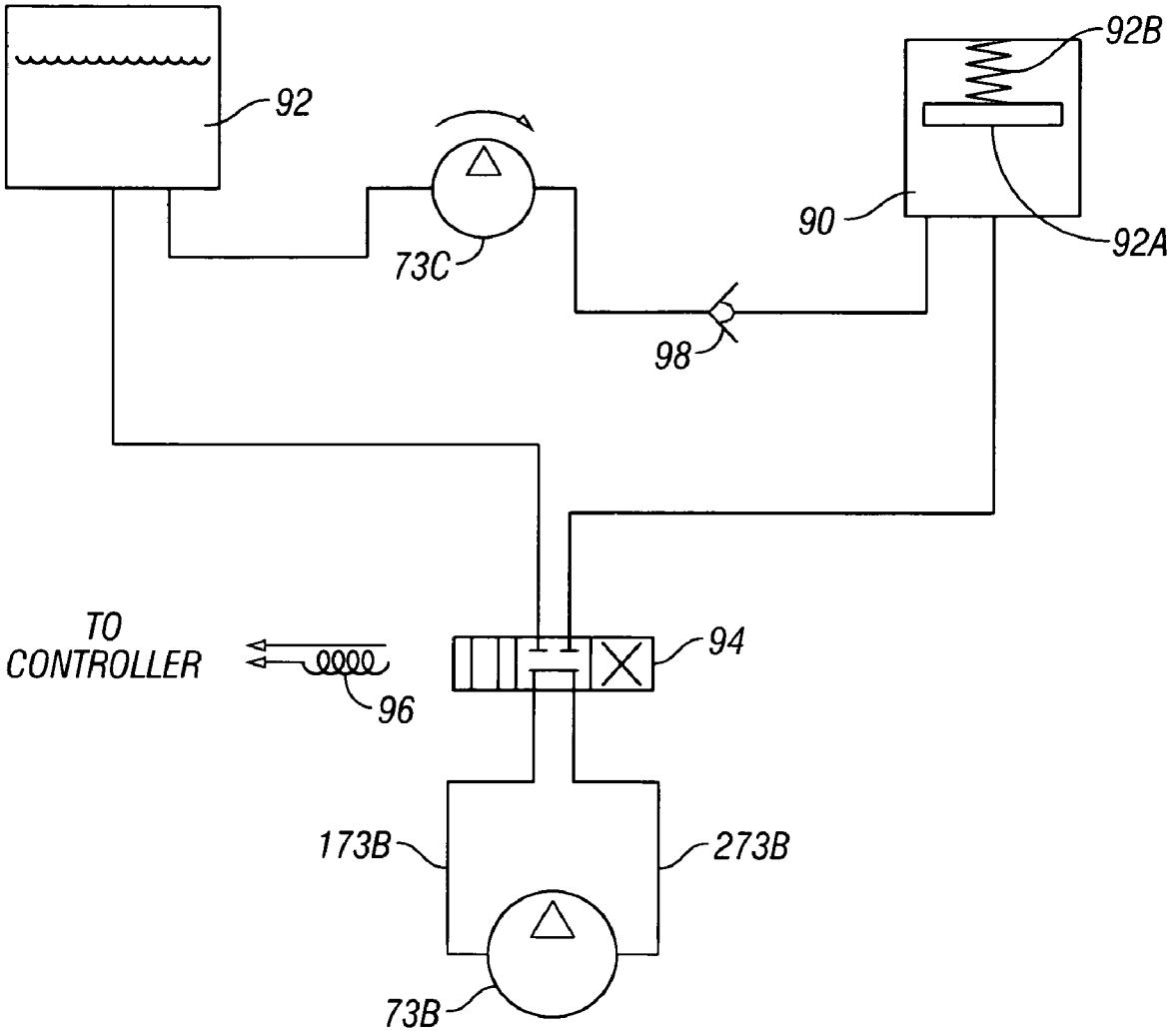
FIG. 4C shows an alternative type of motor that may be used in some embodiments according to FIG. 4A or 4B.

When it is determined that braking force is needed, the three-way valve 94 is moved to the leftmost position in FIG. 4C. The outlet line 273B of the motor 73B is then coupled to an accumulator 90. The accumulator 90 can be conventional in design and include a piston 92A biased by a spring 92B to maintain hydraulic pressure on one side of the piston 92A. Thus, the motor 73B pumps fluid against pressure in the accumulator 90 so as to provide resistance to rotation by the wheel. Fluid to be pumped by the motor 73B is supplied by the three way valve 94 connecting the inlet line 173B of the motor 73B to a reservoir 92. When used as a brake, the motor 73B will provide some regenerative charging of the accumulator 90.

When it is determined that motive force is required for the deployment device, the three way valve 94 may be moved to the right hand position in FIG. 4C, so as to couple the inlet line 173B of the motor 73B to the pressurized fluid in the accumulator 90, thus driving the motor 73B.

In some embodiments, pressure charge may be maintained in the accumulator 90 by a separate pump 73C which may be driven by a separate motor, or a turbine exposed to flow of fluid in the wellbore or other type of drive mechanism. The pump 73C transfers fluid from the reservoir 92 to the accumulator 90 to maintain pressure therein. The outlet line of the pump 73C may include a check valve 98 to prevent leak off of pressure through the pump 73C when the pump is not operating.

Figure 5:
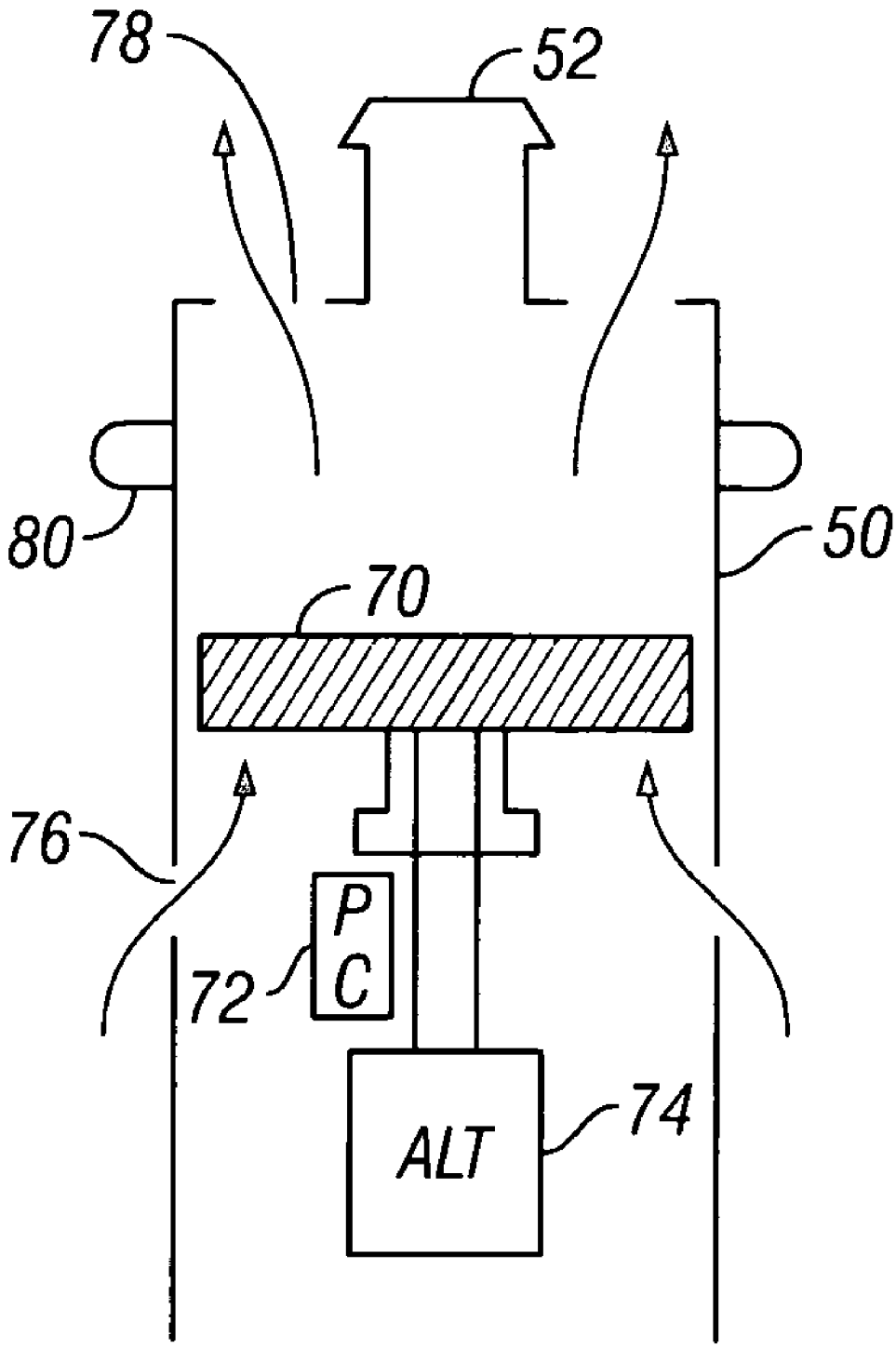
FIG. 5 shows an alternative braking mechanism for a deployment device.

Another embodiment of a braking mechanism that may be used in substitution of or in addition to the inductive traction device explained above will now be explained with reference to FIG. 5. The mandrel 50 may include near the upper end fluid inlet ports 76 which admit drilling fluid from inside the conduit (drill string) as the deployment device s moved downwardly through the conduit. Fluid may be urged to flow through the inlet ports 76 by a seal cup 80 or similar fluid deflecting device disposed on the outside of the mandrel 50. The moving fluid travels inside the mandrel 50 and past blades on a turbine 70. The pitch of the turbine blades may be adjusted by a pitch controller 72. The pitch controller 72 may be under functional control of the controller (58 in FIG. 4). Adjusting the blade pitch to be more parallel with the fluid flow direction decreases the amount of fluid flow that is converted to rotation of the turbine 70, and consequently, the amount of resistance to fluid flow created by the turbine 70. Conversely, within certain limits adjusting the blade pitch to be more transverse to the fluid flow will increase the resistance to fluid flow and the amount of flow energy converted to rotational energy of the turbine 70. The turbine 70 may be rotationally coupled to a generator or alternator 74 to convert rotational energy into electric power to charge the battery (62 in FIG. 4). The controller (58 in FIG. 4) may continuously operate the pitch controller 74 to adjust the turbine blade pitch such that a selected speed of movement of the instrument (12 in FIG. 1) is substantially maintained.

It will be readily appreciated by those skilled in the art that other forms of regenerative braking may be used to control the speed of motion under gravity of a logging instrument inside a conduit. Such regenerative braking may include rotating a hydraulic pump to convert motion into hydraulic pressure, for example.

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

What is claimed is:

1. A deployment device for controlling rate of movement of an instrument inside a conduit, comprising:

a mandrel including a coupling to affix the deployment device to the instrument; and a controllable brake disposed in the mandrel, the brake controllably actuatable to maintain the mandrel and the instrument at a selected speed within the conduit, wherein the brake comprises at least one wheel urged into frictional contact with an inner wall of the conduit, the wheel operatively coupled to a motor, and wherein the at least one wheel is magnetically permeable and the motor comprises an induction coil proximate the wheel and coupled to a motor driver, the motor driver configured to apply alternating current to the induction coil such that rotation of the wheel is impeded by regenerative braking.

2. The deployment device of claim 1 wherein electrical power produced by the regenerative braking is conducted to a battery disposed in the mandrel.

3. The deployment device of claim 1 wherein the motor driver is configured to apply alternating current to the induction coil so as to cause the wheel to provide driving force to the mandrel.

4. The deployment device of claim 1 wherein the wheel is urged into contact with the inner wall by a biasing device.

5. The deployment device of claim 4 wherein the biasing device comprises a bow spring.

6. The deployment device of claim 1 wherein the motor comprises an hydraulic motor in selective hydraulic communication with an accumulator.

7. The deployment device of claim 1 further comprising a selectable pitch turbine and a flow diverter associated with the turbine such that fluid flow past the mandrel as the deployment device is moved in the conduit is modified by the turbine.

8. The deployment device of claim 7 further comprising an electrical generator rotatably coupled to the turbine.

9. The deployment device of claim 1 further comprising a controller in signal communication with the motor driver and a motion responsive sensor, the sensor providing signals corresponding to motion of the deployment device, the controller configured to maintain a selected speed of motion in response to signals from the motion responsive sensor.

10. The deployment device of claim 9 wherein the motion responsive sensor comprises an accelerometer.

11. The deployment device of claim 1 wherein the motor is rotationally coupled by gearing to the at least one wheel.

12. A deployment device for a well logging instrument disposed in a conduit, comprising:

a mandrel including a coupling to affix the deployment device to the instrument; and a drive mechanism disposed in the mandrel, the drive mechanism including at least one traction wheel urged into contact with an interior wall of the conduit by a biasing device, the drive mechanism including a motor arranged to rotate the at least one traction wheel to provide motive power to the mandrel, the motor comprising an induction coil proximate the traction wheel and the traction wheel is made from a magnetically permeable material, the motor operably coupled to a motor driver arranged to conduct alternating current through the induction coil, whereby the wheel functions as a rotor in an induction motor.

13. The deployment device of claim 12 wherein the motor comprises a gear coupling to the at least one traction wheel.

14. The deployment device of claim 13 wherein the gear coupling comprises a ring gear disposed on the at least one traction wheel.

15. The deployment device of claim 12 wherein the motor driver is configured to conduct alternating current through the induction coil so as to cause the traction wheel to exert regenerative braking force on the mandrel.

16. The deployment device of claim 12 wherein the biasing device comprises a bow spring.

17. The deployment device of claim 12 further comprising a brake, the brake including a selectable pitch turbine and a flow diverter associated with the turbine such that fluid flow past the mandrel as the deployment device is moved in the conduit is modified by the turbine.

18. The deployment device of claim 17 further comprising an electrical generator rotatably coupled to the turbine.

19. The deployment device of claim 12 further comprising:

a controller in signal communication with the motor driver; and a motion responsive sensor arranged to provide signals corresponding to motion of the deployment device, the controller configured to maintain a selected speed of motion in response to signals from the motion responsive sensor.

20. A deployment device for controlling rate of movement of an instrument inside a conduit, comprising:

a mandrel including a coupling to affix the deployment device to the instrument; and a controllable brake disposed in the mandrel, the brake controllably actuatable to maintain the mandrel and the instrument at a selected speed within the conduit, wherein the brake comprises a motor rotationally coupled by gearing to at least one wheel in frictional contact with an inner wall of the conduit.

21. The deployment device of claim 20 wherein the wheel is urged into contact with the inner wall by a biasing device.

22. The deployment device of claim 21 wherein the biasing device comprises a bow spring.

23. The deployment device of claim 20 wherein the motor comprises an hydraulic motor in selective hydraulic communication with an accumulator.

24. The deployment device of claim 20 further comprising a controller in signal communication with the motor driver and a motion responsive sensor, the sensor providing signals corresponding to motion of the deployment device, the controller configured to maintain a selected speed of motion in response to signals from the motion responsive sensor.

25. The deployment device of claim 24 wherein the motion responsive sensor comprises an accelerometer.

26. A deployment device for controlling rate of movement of an instrument inside a conduit, comprising:

a mandrel including a coupling to affix the deployment device to the instrument; and a controllable brake disposed in the mandrel, the brake controllably actuatable to maintain the mandrel and the instrument at a selected speed within the conduit, wherein the brake comprises a selectable pitch turbine and a flow diverter associated with the turbine such that fluid flow past the mandrel as the deployment device is moved in the conduit is modified by the turbine.

27. The deployment device of claim 26 further comprising an electrical generator rotatably coupled to the turbine.

28. The deployment device of claim 26 further comprising a controller in signal communication with a pitch controller and a motion responsive sensor, the sensor providing signals corresponding to motion of the deployment device, the pitch controller configured to change turbine pitch to maintain a selected speed of motion in response to signals from the motion responsive sensor.

29. The deployment device of claim 28 wherein the motion responsive sensor comprises an accelerometer.

* * * * *